US007374358B2

(12) United States Patent
Neuner et al.

(10) Patent No.: US 7,374,358 B2
(45) Date of Patent: May 20, 2008

(54) SEALED COSMETIC WIPER

(75) Inventors: Charles P. Neuner, Amityville, NY (US); William Bickford, Northport, NY (US)

(73) Assignee: ELC Management, LLC, New York, NY (US)

( * ) Notice: Subject to any disclaimer, the term of this patent is extended or adjusted under 35 U.S.C. 154(b) by 433 days.

(21) Appl. No.: 11/069,436

(22) Filed: Mar. 1, 2005

(65) Prior Publication Data

US 2006/0198690 A1 Sep. 7, 2006

(51) Int. Cl.
*A46B 11/00* (2006.01)
*A46B 17/08* (2006.01)

(52) U.S. Cl. ..... 401/126; 401/122

(58) Field of Classification Search ..... 401/121, 401/122, 126–130
See application file for complete search history.

(56) References Cited

U.S. PATENT DOCUMENTS 2,703,898 A * 3/1955 Kellett ..... 15/257.05
4,390,298 A * 6/1983 Carluccio ..... 401/122
5,697,720 A * 12/1997 Lhuisset ..... 401/122

* cited by examiner

*Primary Examiner*—David J Walczak
(74) *Attorney, Agent, or Firm*—Peter Giancana

(57) ABSTRACT

A sealed wiper for a mascara bottle or other container that uses a wiper. The sealed wiper has novel venting features on its exterior to allow air that has been displaced from the container to escape to the outside. In this way, a sealed wiper may be seated on a container without the build up of pressure inside the container.

34 Claims, 7 Drawing Sheets

SEALED COSMETIC WIPER

FIELD OF THE INVENTION

The present invention pertains to wipers for mascara containers or other packaging and more particularly to sealed wipers that allow air to vent from the container other than through the interior of the wiper.

BACKGROUND OF THE INVENTION

Mascara packaging commonly comprises a container in the form of a cylindrical bottle having a neck with threaded finish. The neck has an orifice through which the bottle is filled and through which a brush-rod assembly is inserted. The brush rod-assembly depends from a threaded closure that fits onto the threaded neck finish. Furthermore, typical mascara packaging comprises a wiper situated in the orifice of the neck. The purpose of the wiper, as is well known in the art, is to clean the rod as it is withdrawn from the filled bottle by a consumer, remove excess mascara from the brush and smooth out the mascara on the brush prior to application to the eyelashes.

A typical prior art wiper is shown in FIGS. 1 and 2. Broadly defined, the wiper (100) is a hollow cylinder. The typical wiper has one retention bead (101). When the wiper is fully seated on a mascara bottle, the bead fits into a complimentary retention groove located on the inner wall of the bottle neck. The bead and neck groove stabilize the wiper in the bottle neck by opposing any movement of the wiper, as for example, when the brush passes through the wiper. A lower section (102) of the wiper is tapered such that it has a smaller diameter than that of the upper section (103) of the wiper. The upper section terminates in an upper orifice (104) and the lower section terminates in a lower orifice (105). As commonly practiced, the lower orifice diameter is typically between 0.139 and 0.163 inches, although other sizes may be in use and the present invention is not limited by the size of the lower orifice. This range of orifice diameters accommodates most of the brush-rod applicator assemblies currently in use.

A packaging supplier may provide mascara bottles to a filler with the wiper already fully seated in the neck and the retention bead located in the neck groove. This saves the filler the time, cost and effort of having to assemble those components before filling. Most fillers opt to have the supplier insert the wipers because inserting thousands of wipers requires costly wiper-insertion equipment, requires maintenance of that equipment and because the cost of any damaged components that result from machine or operator malfunction must be borne by the filler. Alternatively, the wiper and bottle may be assembled at the filling site, which saves for the filler, the cost that the supplier would charge for this service, but again this is not usually done.

Each bottle is filled by inserting a fill tube into the wiper down to the level of the lower orifice of the wiper. Some clearance is maintained between the lower orifice and the filling tube, like 0.005 inches. Once the bottle with wiper is filled, a closure is placed over the wiper and attached to the bottle, usually via thread engagement. The closure is placed on the bottle immediately after filling, to protect the product in the container from contamination and degradation. In this configuration, the wiper is hidden from view and generally, will not be seen by a customer or consumer until after the product has been purchased. Because the wiper is concealed prior to purchase there is little or no motivation to make the wiper visually interesting nor to use the wiper to convey information to the customer. Typical wipers, beyond their primary function, are visually uninteresting and generally monotone, i.e. white, gray or black and are free of any markings or attachments.

The cosmetic market and consumer goods markets in general, are highly competitive. Success or failure in the marketplace often depends on the ability of a package to catch the interest of the customer through visual stimuli and to convey relevant information to the customer. However, the decision of which advertising or marketing approach to use depends on the cost of implementing that approach. Therefore, the marketing and advertising industries are constantly seeking new ways to lure customers to their products and away from a competitor's product while doing so for the least possible cost. The costs associated with decorating, advertising and conveying information on each individual unit sold are variable costs. That is, the total cost of the decorating and advertising increases for each item produced. Therefore, anything that reduces total variable cost while still producing a package that will be competitive in the marketplace has a very positive impact on the bottom line and is always an advantage. A further advantage is realized when the product is offered in a completely novel way that redefines how such products may be placed in front of the consumer and captures the interest of the consumer.

One type of variable cost arises when a single product is available to consumers in a variety of options. For example, the same mascara product may be available in eight different colors or shades. Typically, these eight different S.K.U.s (stock-keeping units) are sold in the same packaging (i.e. container, closure and brush) but the packaging is labeled or decorated differently for each shade. The need to convey the shade information to the consumer in this way has certain associated costs that may not be readily apparent. In the mascara example, the shade information would have to be placed on the container or the closure. Therefore, the mascara manufacturer must maintain a stock of eight different packaging components, one labeled for each shade. At any given moment, however, it is impossible for the manufacturer to know exactly how many of each packaging component is going to be needed. Not wanting to be caught short of stock, a manufacturer will always keep an over-supply of components, estimating the numbers needed to meet demand. Those numbers depend on several factors, most notably market demand for each particular shade. But it may also depend on the availability of the raw materials required to make a product in a particular shade or it may depend on changing regulatory requirements regarding those raw material ingredients or perhaps other factors. In every manufacturing operation of this type, material waste and lost investment arise due to unused componentry. The waste and lost investment are obviously greater when more expensive components go unused. Therefore, to the extent that nearly identical packaging componentry is going to be used to market variations of the same product, it is economically advantageous if the component that distinguishes different shades or variations could be the least expensive component, thus minimizing lost investment and reducing total variable cost. At the same time, the most expensive components would contain only generic information and therefore be usable for producing units in any shade. No matter how the market demand for shades may change, the manufacturer can draw the most expensive components from a single stock, rather than eight different stocks. Fewer expensive components will sit unused in the warehouse where they generate no income and fewer expensive components will ultimately be discarded resulting in lost investment. Furthermore, by itself, the need to keep eight separate stocks in a warehouse increases the cost of manufacture, although this is not strictly a variable-type cost.

Another variable cost, lost investment due to some stock not selling, is a fact of doing business. Using the mascara example, if all units of a product do not sell, those salable units will be destroyed and the total investment in the unit will be lost. This includes, the product, the container and the closure-applicator assembly, which has contacted the product. Therefore, another advantage would be gained by a method of selling mascara wherein the closure-applicator assembly (the most expensive part) is not secured to the container prior to sale. In this way, if the product does not sell, the closure-applicator assemblies do not need to be destroyed.

Yet another variable cost is associated with assembling componentry to make the finished good. For example, as mentioned above, a typical mascara filling operation includes placing a closure or cap (which carries the brush applicator) onto the bottle and twisting the closure on the bottle to form a tight seal. This part of the operation requires expensive, sophisticated equipment and routinely results in lost investment through equipment malfunction, such as cap mis-feeds. The advantages are clear if this step in the operation could be eliminated and replaced with a simpler, less costly alternative.

There are other disadvantages in the way that mascara and some other cosmetics are marketed to the consumer. Generally, any product that is sold with an applicator, such as mascara, comes with a pre-selected applicator, a brush for example. The customer has no choice in the matter. If the customer wants the particular mascara product, she must accept the brush packaged with it. In fact, because the brush is always hidden from view, inside the container, the customer usually does not even know what brush she is buying. This is a great disadvantage to the customer because different types of eyelashes or differing personal tastes, such as brush comfort, require different types brushes. As any person skilled in the art of mascara brushes knows, a lot of research and development by cosmetic companies has gone into mascara brush design. Nevertheless, at the point of sale, the customer is not in a position to benefit from the wide variety of brushes that have been developed. The market still forces a one-size-fits-all approach, even in this highly competitive environment. This is because all efforts to offer brush choice to the consumer are not cost-effective and may require the assistance for a sales associate to complete the transaction. A great benefit to the customer and a tremendous marketing advantage to the manufacturer would be realized if a cost-effective method was available to allow the mascara customer to choose her own brush, without the aid of a sales associate.

Another per unit cost associated with mascara production is the cost of filling each bottle. That cost depends on the rate at which bottles are filled. The rate at which bottles may be filled is limited, in part, by the size of the lower orifice of the wiper. As discussed the filling tube is conventionally a little smaller than the lower orifice. If this constraint could be removed so that a larger filling tube could be used, then the rate at which filling occurs could be increased. The entire filling operation would be made more cost effective.

Conventional mascara packaging requires that all of the packaging components (container, wiper and closure-applicator assembly) be present in the plant at the time of filling the containers with mascara. From a practical planning point of view, this means that the lead time before filling depends on the longest-lead component. For conventional mascara packaging the longest-lead component is the closure-applicator assembly. Because the containers and wipers are easier and faster to manufacturer, they will generally be available well before (often several weeks before) the closure-applicator assembly. If the lead time for receiving the closure-applicator assembly could be removed from the filling schedule, then a time and cost savings may be realized in the filling operation.

All of the foregoing disadvantages may be overcome and all of the foregoing advantages may be realized in a simple, cost-effective package that features a sealed wiper. To the best of the applicant's knowledge, a wiper has never been exploited as a means of conveying information to a consumer or for advertising or other marketing advantage. Nor has the wiper ever been exploited to provide cost savings related to the manufacture, marketing, sales and lost investment. Nor has a sealed wiper according to the present invention ever been disclosed, to the best of the applicant's knowledge.

OBJECTS OF THE INVENTION

A main object of the present invention is to reduce variable costs associated with producing cosmetic packaging that comprises a wiper.

Another object of the present invention is to reduce the lost investment associated with producing cosmetic packaging that comprises a wiper.

Another object of the present invention is to reduce the unrealized income associated with producing cosmetic packaging that comprises a wiper.

Another object of the present invention is to reduce the lost investment associated with destroying finished goods packaging that comprises a wiper.

Another object of the present invention is to reduce the variable costs of assembling cosmetic packaging that comprises a wiper.

Another object of the present invention is to provide cosmetic packaging that can be marketed in a cost-effective manner, such that the consumer can see the applicator.

Another object of the present invention is to provide cosmetic packaging that can be marketed in a cost-effective manner, such that the consumer may have a choice of applicator.

Another object of the present invention is to increase the rate at which mascara bottles may be filled.

Another object of the present invention is to reduce the lead time in the container filling operation.

SUMMARY OF THE INVENTION

The present invention is a sealed wiper for a mascara bottle or other container that uses a wiper. The sealed wiper has novel venting features on its exterior to allow air that has been displaced from the container to escape to the outside. In this way a sealed wiper may be seated on a container without the build up of pressure inside the container. Simultaneously, the novel wiper-with-seal configuration lends itself to a number of marketing benefits and production efficiencies.

DETAILED DESCRIPTION OF THE INVENTION

Figure 1:
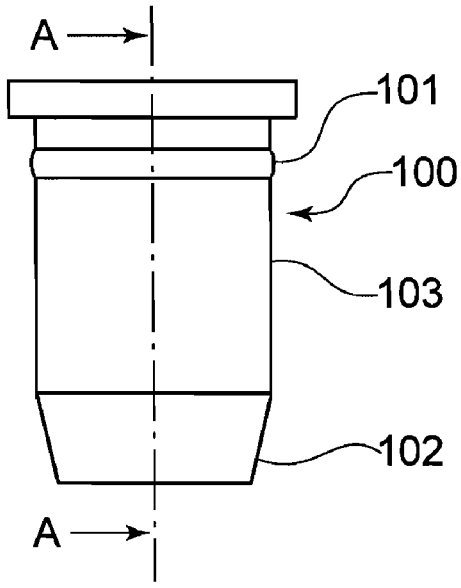
FIG. 1 (Prior Art)
FIG. 1 is a typical prior art wiper.
Figure 2:
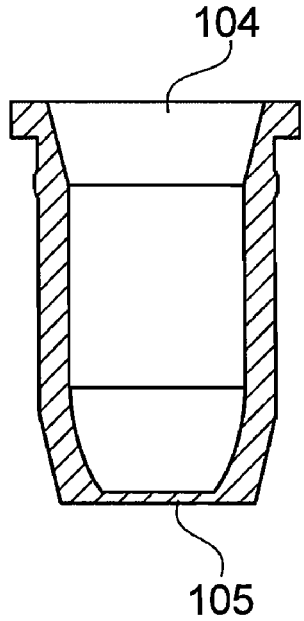
FIG. 2 (Prior Art)
FIG. 2 is a cross section through line A-A of FIG. 1.
Figure 3:
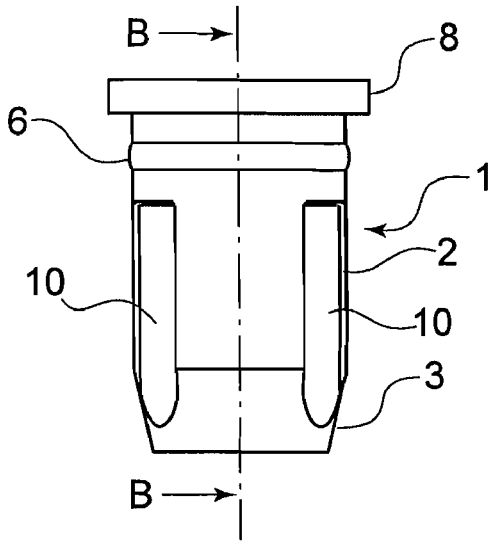
FIG. 3 is an elevation view of one non-limiting embodiment of a sealed wiper according to the present invention, having recessed venting means.
Figure 4:
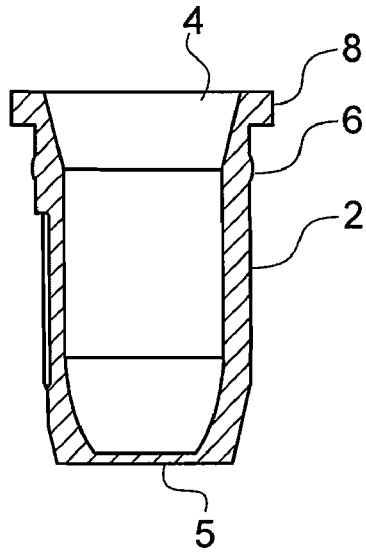
FIG. 4 is a cross section through line B-B of FIG. 3.

Throughout this specification, the terms "comprise," "comprises," "comprising" and the like, shall consistently mean that a collection of objects is not limited to those objects specifically recited.

For convenient reference only, the following description uses mascara packaging to describe aspects of the present invention. However, nothing in this description is intended to limit the present invention to mascara packaging. Referring to FIGS. 3-5 and 9, a novel wiper (1) according to the present invention comprises a hollow cylinder. The cylinder comprises at least two sections, an upper section (2) and a tapered section (3) located below the upper section. The upper section terminates in an upper orifice (4) and the lower section terminates in a lower orifice (5). The upper section has a retention bead (6). When the wiper is fully seated on a mascara bottle, the retention bead fits into a complimentary retention groove (7) located on an inner wall (30) of the bottle neck. The bead and neck groove stabilize the wiper in the bottle neck by opposing any movement of the wiper, as for example, when the brush passes through the wiper. As commonly practiced, the lower orifice is typically between 0.139 and 0.163 inches, although other sizes may be in use. The present invention is not limited to any particular range of lower orifice sizes and may be adjusted to accommodate changing requirements of brush-rod applicator assemblies. A flange (8) surrounds all or a substantial portion of the top of the upper section (2).

Figure 9:
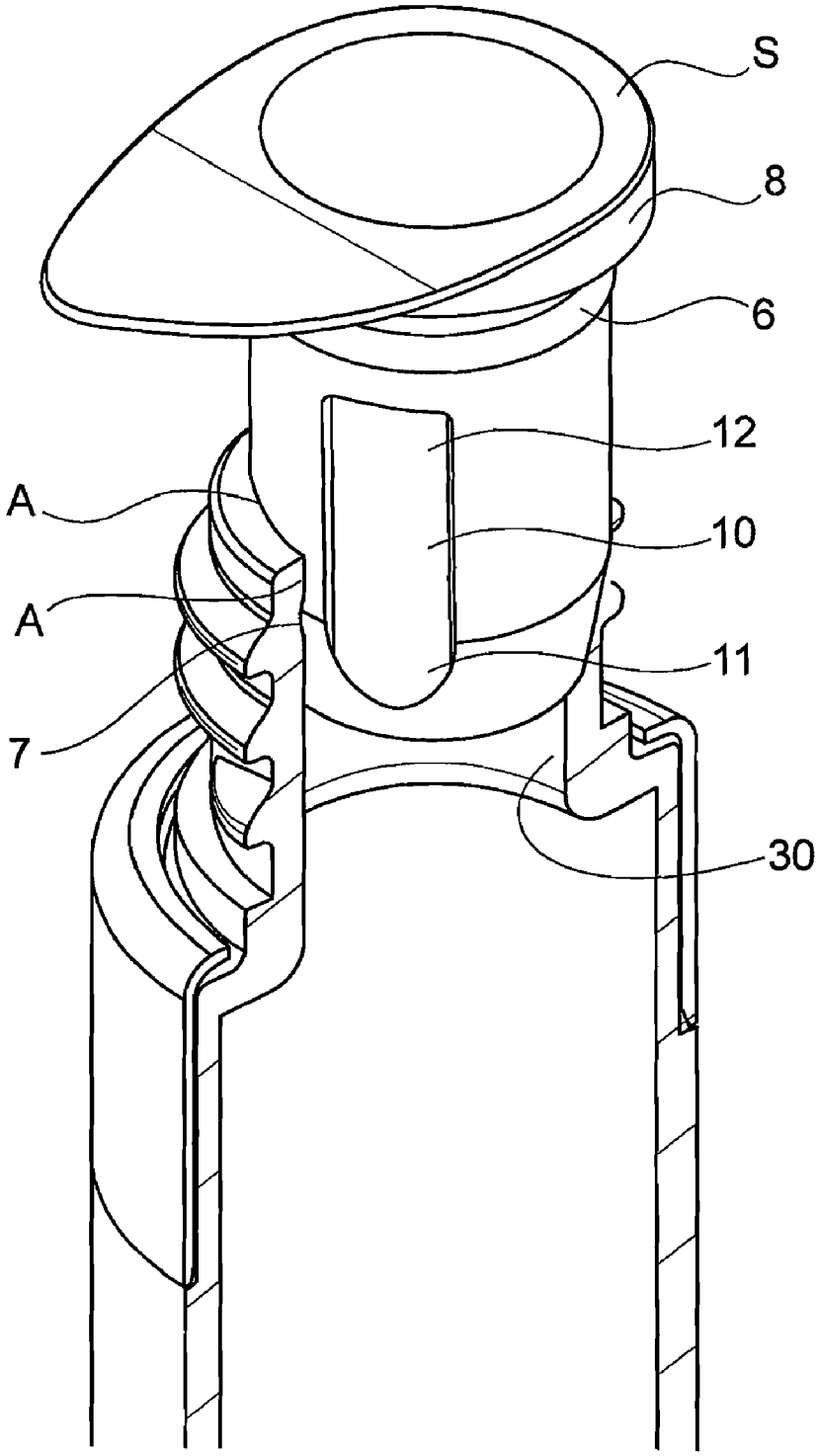
FIG. 9 is a wiper according to the present invention partially inserted into a mascara bottle. A portion of the bottle neck has been removed to expose the wiper.

As a conventional wiper is inserted into a mascara bottle, but before the wiper is fully seated, an airtight seal is formed by the contact between some portions of the outer wall of the upper section and the inner wall (30) of the neck. In FIG. 9, "A" denotes, individually and collectively, all such airtight seals that may form between the outer wall of the wiper and the inner wall of the neck. Furthermore, by "airtight seal" it is meant that, during filling, air cannot pass through the airtight seal and out of the container as fast as the air is being displaced by wiper. With a conventional wiper one or more airtight seals would form before the wiper is fully seated so that as the wiper is further inserted into the bottle, displaced air would normally flow through the interior of the wiper and out of the upper orifice. However, in the wiper of the present invention the upper orifice is blocked by the presence of an barrier or seal (S) stretching across the upper orifice (see FIGS. 6 and 9). Therefore, as the airtight seal begins to form around the outside of the wiper, further insertion of the wiper into the bottle would create a build up of pressure inside the bottle. Built up pressure inside the bottle may be destabilizing to the product or package or it may prevent the wiper from being completely seated. To avoid this build up of pressure a wiper according to the present invention uses venting means to allow the displaced air to vent from the container without having to go through the interior of the wiper. A wiper according to the present invention is provided with some means for interrupting the airtight seals (A). When such means are provided, air inside the bottle may escape without passing through the upper orifice.

One means for interrupting the airtight seal is a novel wiper having one or more grooves (10) recessed into the outer wall of the wiper. In one class of embodiments, one portion of each of the one or more grooves is located on the outer wall of the tapered section (3), below the level where the airtight seal (A) will occur as the wiper is being inserted into the neck. A second portion of each of the one or more grooves is located on the outer wall of the upper section (2). For at least some of the time that the wiper is being inserted into the neck, this second portion must be above the level of the airtight seal. During that time, an air passage exists from the inside to the outside of the bottle.

For example, the first portion of a groove may be the lower end of the groove. The lower end may coincide with the bottom of the tapered section or it may lie above the bottom of the tapered section. In either case, during assembly of the wiper into the bottle neck, the lower end of the groove is always below the level where the airtight seal is forming. Therefore, the lower end of the groove has fluid contact with the displaced air before a substantial build up of pressure inside the bottle can occur.

The second portion of a groove may be the upper end of the groove. During insertion of the wiper into the neck, the upper end of the groove moves closer and closer to the level of the airtight seal. Eventually, the upper end of the groove will be completely inside the neck and sealed off from the ambient atmosphere by the airtight seal (A). Prior to its being sealed off, the upper end of the groove is above the level of the airtight seal and, during that time, an air passage exists from the inside to the outside of the bottle. While this air passage exists, air displaced by the advancing wiper escapes from the bottle through the air passage, without having to pass through the upper orifice of the wiper. Most of the displaced air is evacuated in this manner. However, once the wiper has been so far inserted into the neck, the air tight seal closes off the upper end of the groove. Thereafter, air cannot escape from the bottle and some rise in pressure is incurred. However, with optimal placement of the upper end of the groove, the rise in pressure can be so minimized as to have no deleterious effect on the product or the package or the production thereof. For example, the upper end of the groove may lie just under the retention bead, where the retention bead is normally placed close to the flange (8) or upper end of the wiper. Alternatively, the upper end of the groove may lie between the retention bead and the flange. In this case the retention bead will be interrupted, but this may cause no difficulty as long as the retention bead can still perform its retention function. Alternatively, the upper end of the groove may abut the flange or even penetrate partially into the flange. In this way, virtually all the displaced air is able to escape from the bottle.

Figure 5:
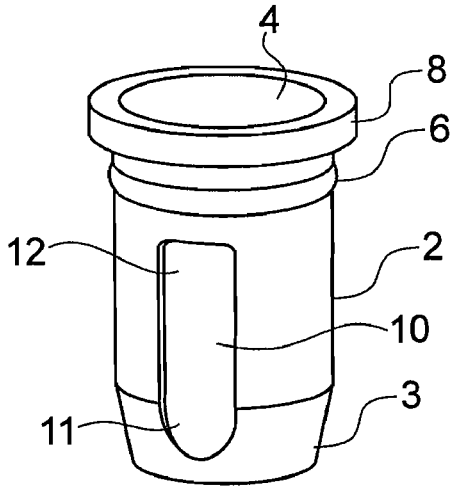
FIG. 5 is an isometric view of the wiper of FIG. 3.

One embodiment is shown in FIGS. 5 and 9 wherein a groove (10) has a lower end (11) located on the outer wall of the tapered section and an upper end (12) located on the outer wall of the upper section just blow the retention bead (6). With any of these alternatives, air inside the bottle will be able to flow to the outside of the bottle without passing through the upper orifice of the wiper.

Figure 7A:
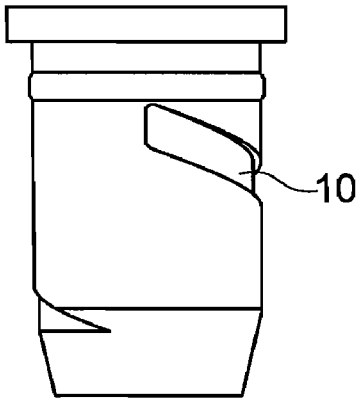
FIGS. 7A and 7B form an elevation view of a wiper according the to the present invention with a helical groove.
Figure 7B:
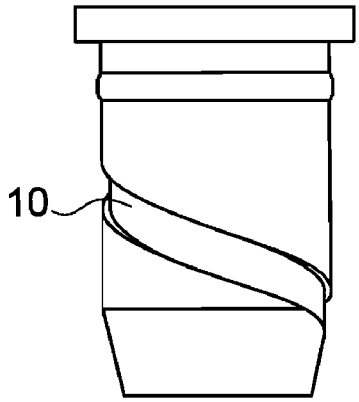
Figure 8:
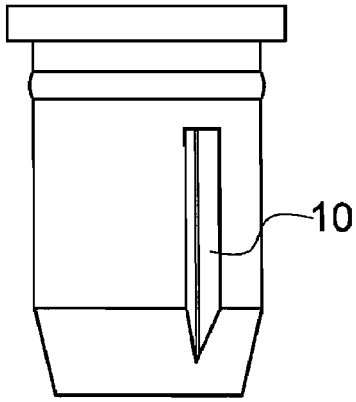
FIG. 8 is a elevation view of a wiper according the to the present invention with a notched groove.

Except as just described, the exact location of the upper and lower ends of the one or more grooves may be decided by concerns such as cost and ease of manufacture. As long as the upper and lower ends of the grooves are as defined above, the overall shape of the groove is virtually unlimited. The simplest groove may be straight and roughly parallel to the longitudinal axis of the wiper. Alternatively, a straight groove may be inclined at some angle to the longitudinal axis of the wiper, for example, it may be a helical groove (see FIGS. 7A and 7B). The groove may have a flat or curved bottom or the groove may be an angled notch, as depicted in FIG. 8.

In an alternative embodiment, some portion of the groove other than the lower end may lie on the outer wall of the tapered section (3) below the airtight seal (A) and some portion other than the upper end may lie on the outer wall of the upper section (2) above the airtight seal. For example, the groove may be "U"-shaped, so that both the first and second ends of the "U" lie above or below the airtight seal, while the turn of the "U" lies below or above the airtight seal, respectively. Alternatively, the groove may have no well-defined end at all. For example, such grooves may extend around the circumference of the wiper in a closed geometric shape, like a saw-tooth or sinusoidal pattern that closes on itself. As long as some portion of each groove is located within the two critical areas, i.e. above and below the airtight seal, then the overall shape of the groove does not matter, because air will be able to escape from the bottle as the bottle is being filled, the air not having to pass through the upper orifice of the wiper.

Any suitable number of grooves as described may be provided on a single wiper. One critical factor is the total volume of all grooves on the wiper. This total volume should be sufficient to allow air to escape from the bottle during filling, as quickly as the air is being displaced by product. Depending on the dimensions of a groove, more than one groove may or may not be necessary. Although, in practical terms there may be no reason why one suitably sized groove could not be placed on any known cosmetic bottle wiper. In many cases a person skilled in the art may determine the requisite number of grooves by routine experimentation.

The volume of a groove will be determined by its linear dimensions. If the groove is geometrically simple, then we may refer to each groove's length, width and depth or length and radius, as appropriate. For guidance, one may want to limit the depth or radius of each groove to 25%-75% of the thickness of the wiper wall. However, this range may be exceeded if the integrity of the wiper will not be substantially compromised. The relevant dimensions may be readily determined by a person skilled in the art of wiper design and manufacture.

A wiper according to the present invention may be made of conventional materials such as natural or synthetic rubber, silicone and non-silicone elastomers and plastics. Some preferred materials are high and low density polyethylene and polypropylene. A wiper according to the present invention may be made by conventional molding methods and the present invention is not limited to any particular manufacturing method.

Figure 6:
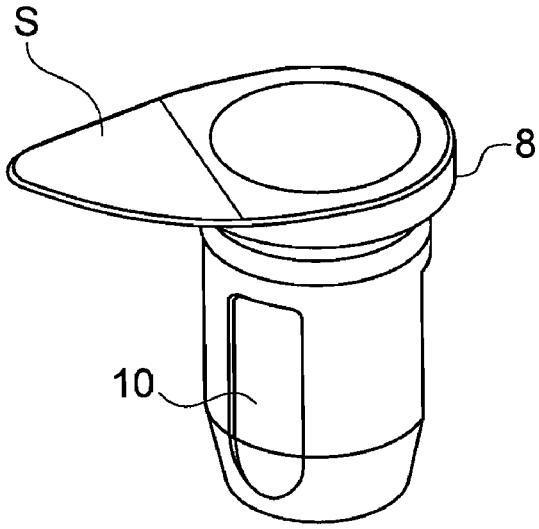
FIG. 6 is an isometric view of a wiper according to the present invention with seal intact.
Figure 10:
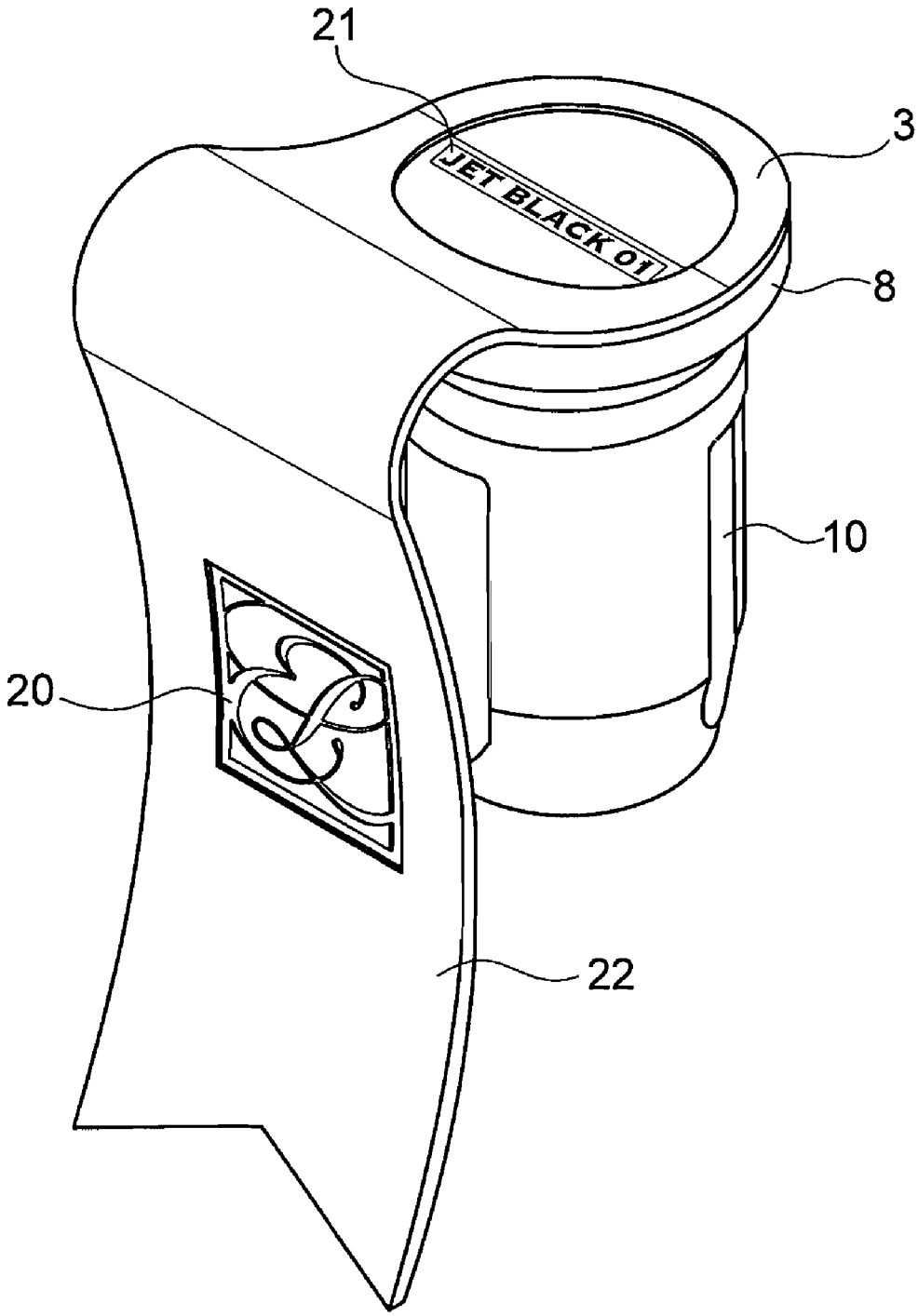
FIG. 10 is a wiper according to the present invention with auxiliary structure depending from the seal.
Figure 11:
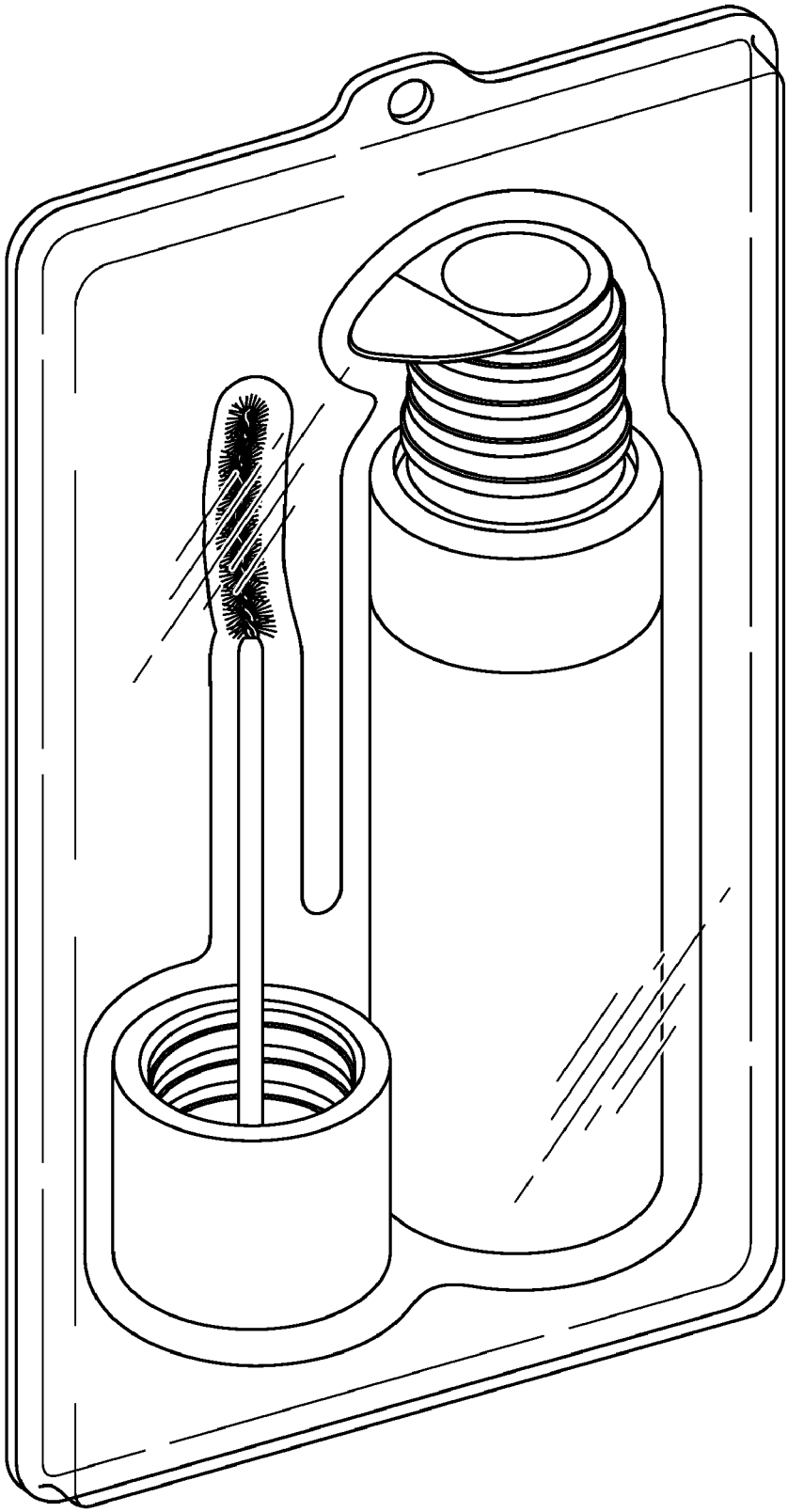
FIG. 11 is an example of a bottle with inserted wiper according to the present invention, and a separately supplied applicator, packaged together in an outer packaging.
Figure 12A:
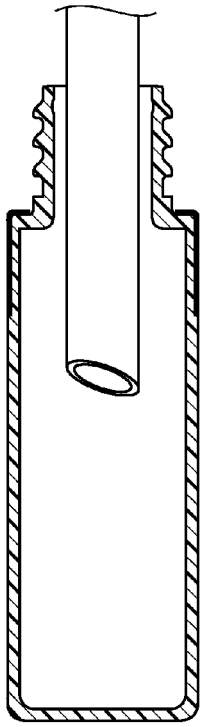
FIG. 12 depicts a filling method, wherein a wiper according to the present invention is inserted into the container after the container is filled.
Figure 12B:
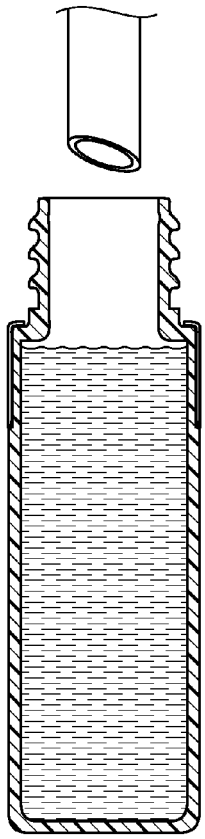
Figure 12C:
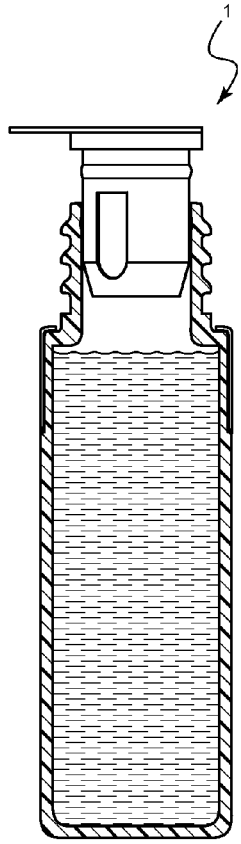

In a wiper of the present invention the upper orifice is blocked by the presence of a barrier or seal (S) stretched across the upper orifice (see FIGS. 6, 9 and 10). This seal may take many forms, the only critical requirement being that the seal operates as an effective barrier. By "effective barrier" it is meant that ambient influences cannot penetrate the seal in either direction, beyond an acceptable level. When a sealed wiper of the present invention is seated on a bottle, the interior of the bottle is protected from external ambient influences by the effective barrier and furthermore, the effective barrier prevents the contents of the bottle from leaving the bottle. An example of the latter is when a cosmetic product comprises one or more volatile components that would volatilize away, thus harming the product.

The seal may be comprised of a membrane that spans the upper wiper orifice, covering the orifice completely. The seal may be affixed to the perimeter of the upper orifice and/or flange. Alternatively, the seal may extend beyond the top of the flange and wrap around the side wall of the flange. The seal is preferably flexible. For example, the seal may be a membrane of plastic, rubber or metal foil or a combination. The use of such materials for creating a barrier to ambient conditions and for inhibiting the migration of volatile components is well known in the packaging filed and a person skilled in the art may readily choose the appropriate materials for a given situation.

The means of securing the seal onto the wiper include conventional means such as adhesive, heat sealing, welding, integral molding, shrink wrapping or any other means suitable to the purpose. Preferably, the affixed seal is easily peelable from the wiper, so that the consumer has an easy time accessing the product. It may be preferable if the seal can be repeatedly removed and replaced to again form an effective barrier. Adhesives having this property are known, such as some pressure sensitive adhesives. It may be desirable to have a tab feature that gives the consumer a grip surface, so that the seal may be more easily removed. The tab would extend from the seal and could be identical in composition to the seal or it could be different. For example, it may be desirable to make the tab of a more heavy-duty construction to ensure it does not rip prematurely, under the force of pulling by the consumer. The tab may be thicker than the seal if that would make a more effective grip for the user.

Preferably, the filler receives mascara bottles without wipers. The filler fills the mascara bottles without wipers in place and then seats sealed wipers onto the bottles. The advantage to this approach is that the former restriction that filling tube be no larger than the lower orifice of the wiper is removed. Now the filling tube may be almost as large as the bottle orifice. This speeds up production and may require less energy. When a sealed wiper is seated on the bottle, the air displaced in the bottle must exit the bottle through the one or more grooves of the wiper. Air exits the bottle this way until the last little distance that the wiper travels at which time the groove may already be inside the bottle neck and sealed off. However, the last little distance traveled by the wiper does not produce a significant build up of pressure inside the bottle.

Alternatively, the filler may receive bottles with fully seated, but unsealed wipers. The bottles would then be filled through the wiper, in more or less the conventional way, and then the wiper would be sealed. This method may be less efficient, as the wiper sealing operation may slow down production and is a more complicated process than seating wipers.

The seal and/or tab may be used to hold text or graphics (FIG. 10). The text or graphics may be decorative, like a logo (20) or informative. Informative text may comprise information that is generic to a line or brand of consumer goods or that is specific to an S.K.U. within a line of goods. Preferably, the text or graphics is specific to one particular S.K.U. One example of text or graphics that is specific to one particular S.K.U. is information (21) that identifies the shade of mascara in the bottle. This may be one or more words that identify the shade or a colored graphic in the same shade as the product. When any and all specific information is located on the seal and/or tab, then the bottle preferably contains only generic line or brand information. By "generic information" it is meant that information which identifies a product brand or line, but which is not otherwise specific to the S.K.U. contained in the bottle. When only "generic information" is displayed on the container, then the same container may be used for different versions of the same product or different S.K.U's in the same line or brand. When the bottle displays only "generic information" then some of the cost savings and strategic manufacturing advantages discussed above can be realized. In the example given above, a line of mascaras sold in eight shades normally requires eight separate sets of packaging components, each conveying different specific information. The various costs associated with this were discussed. With the present invention, many of these costs are now avoided because the most expensive parts of the package (the bottle and applicator-closure) can be identical for all eight shades. There is no need to maintain an over supply of all eight sets of components and no need to guess how many of each shade are going to be needed at any specific time. Because of this, lost investment is reduced if one or more shades does not sell as expected.

Just as the tab extends from the seal proper and is removed with the seal, so too may virtually any auxiliary structure. For example, information in the form of a printed substrate, such as a card, leaflet, flyer, ribbon (22, in FIG. 10) or booklet, etc. may depend from the seal. The information may be anything that a retailer wants to put in front of a consumer. For example, the information may be the color or shade of the cosmetic product in the container. Or the information may be the ingredients or user instructions or legal information. The information may be text or graphical and may be informative or decorative. Here again, the retailer may place all of the specific S.K.U. information so that the filled container may hold only generic line or brand information. With a sealed wiper according to the present invention, all specific, non-generic information can be displayed on the seal or depended from the seal. Additionally, any decorative element, even if it does not convey product information may be depended from the seal. This may be done purely for visual appeal and marketing purposes.

Some packaging is so small, that it is advantageous if some information does not have to be placed on the primary container. As discussed above, it is advantageous if secondary information, stuff like user instructions, legal information, the ingredients or the shade is not placed on the container. In the present invention, this information is removed from the primary container, thus enhancing the visual appeal of the primary container. Another advantage of removing secondary information from the primary container may be lower printing costs. It is generally more difficult and costly to print to a non-flat plastic surface than to a flat paper surface or cardboard surface.

Also, as discussed above, it is advantageous if the capping operation could be eliminated and it would be advantageous if the consumer could be given a choice of applicator brush. A wiper of the present invention makes both possible because the sealing function of the closure-wiper assembly is replaced by the wiper seal. Therefore, the capping operation is not needed. A mascara bottle filled and sealed with a wiper according to the present invention cannot accept a closure-applicator assembly because the upper orifice is blocked. After filling the bottle and inserting the wiper, a manufacturer has the option of shipping the filled bottles with sealed wipers to the market as is, or further packaging the filled and sealed bottles in an outer packaging before shipping to market. In either case, the consumer will ultimately have to be provided with an applicator and perhaps a closure. This creates the opportunity to offer the consumer a choice of applicator and closure. This is potentially a significant advantage in the marketplace and a clear benefit to the consumer.

One method of supplying the consumer with a choice of applicator and/or closure is to separately supply applicators and closures at the point of sale. By "separately supply" it is meant that the container and applicator/closure are not packaged together. A variety of applicators, for example, different brush types, may be made available for the consumer to choose. Another method of supplying the consumer with a choice of applicator and/or closure includes packaging applicators and containers together in an outer packaging, but in a variety of combinations. Examples of suitable outer packaging include plastic clamshell type packaging or shrink banding. For example, each shade of an eight shade line may be offered with three different applicators, i.e. brushes suitable for thick, thin or medium density lashes. In this example, a retailer may provide mix and match to provide up to twenty-four separate clamshell packages, each shade with any brush. Again, the never before realized opportunity to inexpensively offer this choice to the customer is a significant advantage in the marketplace and a clear benefit to the consumer.

It should be noted, that even if a retailer does not provide the consumer with a choice of applicator, the present invention still offers an advantage to the consumer. Whether, bundled with the container or separately supplied, the consumer is able to see the applicator. With conventional mascara container-wiper systems this is not the case, because the applicator is hidden inside the container. Frequently in the cosmetics and personal care business, the applicator is the main selling point rather than the cosmetic product itself. The present invention affords an opportunity to show off the main selling feature, which may be the result of extensive development and cost.

Another advantage of eliminating the capping operation is a reduction in lost investment associated with destroying finished goods. Destroying finished goods may be necessary for a number of reasons that occur in manufacturing, shipping or at the retail outlet. A significant savings is realized when a package to be destroyed has a comparatively inexpensive seal instead of an expensive closure-applicator assembly.

Another advantage of eliminating the capping operation is the shortened lead-time for filling containers. When a filled container is sealed with a novel wiper of the present invention, there is no need to wait for the relatively slow-to-manufacture closure-applicator assembly. As discussed above, a significant savings of time and cost may be realized if the filler does not have to wait for the closure-applicator assembly before filling. Furthermore, since the closure-applicator assembly already requires the longest lead time, it may sometimes be advantageous to decorate the closure with the text and/or graphical information required for the particular SKU. Placing this information on the closure rather than the container further decreases the lead time for receiving containers a the filling site. When the decorated closure-applicator assemblies are available (perhaps weeks or months after filling the containers) they can be matched to the appropriate filled container.

What is claimed is:

1. A cosmetic wiper comprising a hollow cylinder having an outer wall and comprising:

an upper section terminating in an upper orifice;

a tapered section located below the upper section and terminating in an a lower orifice;

a retention bead located on the upper section;

a wiper groove recessed into the outer wall of the cylinder such that a first portion of the wiper groove is located on the tapered section and a second portion is located on the upper section; and a seal that forms an effective barrier affixed across the upper orifice, the seal comprising a membrane that spans the upper orifice of the wiper, covering the orifice completely.

2. A cosmetic wiper according to claim 1 wherein the wiper groove comprises first and second ends.

3. A cosmetic wiper according to claim 2 wherein the first end is located on the tapered section and the second end is located on the upper section.

4. A cosmetic wiper according to claim 3 wherein the wiper groove is straight and parallel to the longitudinal axis of the wiper.

5. A cosmetic wiper according to claim 3 wherein the wiper groove is helical.

6. A cosmetic wiper according to claim 2 wherein the wiper groove is U-shaped.

7. A cosmetic wiper according to claim 1 wherein the wiper groove has no end.

8. A cosmetic wiper according to claim 7 wherein the wiper groove is sinusoidal.

9. A cosmetic wiper according to claim 7 wherein the wiper groove is saw-toothed.

10. A cosmetic wiper according to claim 1 further comprising one or more additional wiper grooves recessed into the outer wall of the cylinder.

11. A cosmetic wiper according to claim 1, wherein the seal is flexible.

12. A cosmetic wiper according to claim 11, wherein the seal is plastic, rubber or metal foil or a combination thereof.

13. A cosmetic wiper according to claim 1 wherein the means of affixing the seal onto the wiper include adhesive, heat sealing, welding, integral molding and shrink wrapping.

14. A cosmetic wiper according to claim 13 wherein the affixed seal is manually peelable from the wiper so that a consumer may access the product.

15. A cosmetic wiper according to claim 14 wherein the seal can be repeatedly removed and replaced to again form an effective barrier.

16. A cosmetic wiper according to claim 15 wherein the adhesive means is a pressure sensitive adhesive.

17. A cosmetic wiper according to claim 1 wherein the affixed seal comprises a grip surface, so that the seal may be more easily removed.

18. A cosmetic wiper according to claim 17 wherein the grip surface is in the form of a pull tab that extends from the seal.

19. A cosmetic wiper according to claim 18 wherein the pull tab is identical in composition to the seal or of different composition.

20. A cosmetic wiper according to claim 19 wherein the pull tab is made of a more heavy-duty composition than the seal.

21. A cosmetic wiper according to claim 20 wherein the pull tab is thicker than the seal, making a more effective grip for the user.

22. A cosmetic wiper according to claim 1 further comprising text or graphics printed on the seal.

23. A cosmetic wiper according to claim 1 further comprising text or graphics that depend from the seal.

24. A cosmetic wiper according to claim 23 wherein the information is in the form a printed substrate.

25. A consumer package comprising a container, a cosmetic wiper, and a product located in the container;

the container has a neck that has a retention groove;

the cosmetic wiper comprises:

a hollow cylinder having:

an outer wall;

an upper section terminating in an upper orifice;

a tapered section located below the upper section and terminating in an a lower orifice;

a retention bead located on the upper section;

a wiper groove recessed into the outer wall of the cylinder such that a first portion of the wiper groove is located in the tapered section and a second portion is located in the upper section; and a seal that forms an effective barrier affixed across the upper orifice, the seal comprising a membrane that spans the upper orifice of the wiper, covering the orifice completely;

the retention bead of the wiper being located within the retention groove of the neck.

26. In combination, a consumer package according to claim 25 and an applicator.

27. A combination according to claim 26 wherein the consumer package and applicator are located in an outer package.

28. A consumer package according to claim 25 further comprising text or graphics printed on the seal.

29. A consumer package according to claim 28 wherein the text or graphics includes information specific to the product in the container.

30. A consumer package according to claim 25 further comprising text or graphics that depend from the seal.

31. A consumer package according to claim 30 wherein the information is in the form a printed substrate.

32. A consumer package according to claim 31 wherein the text or graphics includes any of the following: ingredients, legal information or user instructions.

33. A consumer package according to claim 25 wherein the container displays information, the information being only generic, such that the same container may be used for different versions of the same product.

34. A method of filling a container that employs a sealed wiper according to claim 1, the method comprising inserting a filling tube into the bottle neck, filling the bottle via the filling tube, removing the filling tube from the bottle and seating the sealed wiper on the bottle.

* * * * *